US006976445B1

(12) United States Patent
Arneson

(10) Patent No.: US 6,976,445 B1
(45) Date of Patent: Dec. 20, 2005

(54) SUBMARINE

(76) Inventor: Weston Arneson, 36743 Clearline Rd., Shevlin, MN (US) 56676

( * ) Notice: Subject to any disclaimer, the term of this patent is extended or adjusted under 35 U.S.C. 154(b) by 0 days.

(21) Appl. No.: 10/852,373

(22) Filed: May 24, 2004

(51) Int. Cl.[7] ..... B63C 11/46; B63G 8/16; B63G 8/18

(52) U.S. Cl. ..... 114/315; 114/332; 114/338

(58) Field of Search ..... 114/312, 313, 315, 114/316, 330–333, 337, 338; 441/135; 405/185, 405/186

(56) References Cited

U.S. PATENT DOCUMENTS

| | | | | | |
|---|---|---|---|---|---|
| 2,948,247 | A | * | 8/1960 | Rebikoff | 114/315 |
| 3,084,654 | A | * | 4/1963 | Rosemberg et al. | 114/315 |
| 3,204,596 | A | * | 9/1965 | Fallon | 114/315 |
| 3,257,982 | A | * | 6/1966 | Meldrum | 114/315 |
| 3,420,202 | A | * | 1/1969 | Oversmith | 114/315 |
| 3,548,771 | A | * | 12/1970 | Hastings | 114/315 |
| 4,841,896 | A | * | 6/1989 | Fury | 114/312 |
| 4,889,066 | A | * | 12/1989 | Neil et al. | 114/334 |
| 5,237,952 | A | * | 8/1993 | Rowe | 114/332 |
| 5,433,164 | A | * | 7/1995 | Sneath | 114/315 |
| 6,273,019 | B1 | * | 8/2001 | Ciamillo, II | 114/312 |

FOREIGN PATENT DOCUMENTS

| | | | | | |
|---|---|---|---|---|---|
| DE | 3739887 | A1 | * | 6/1989 | B63G 8/00 |
| DE | 3804341 | A1 | * | 8/1989 | B63C 11/46 |
| DE | 4229670 | A1 | * | 3/1994 | B63C 11/46 |
| FR | 2703652 | A1 | * | 10/1994 | B63B 7/08 |
| GB | 2338943 | A | * | 1/2000 | B63G 8/22 |
| JP | 06040386 | A | * | 2/1994 | B63G 8/18 |

* cited by examiner

*Primary Examiner*—S. Joseph Morano
*Assistant Examiner*—Ajay Vasudeva
(74) *Attorney, Agent, or Firm*—Jack Lo

(57) ABSTRACT

A submarine is comprised of a hull with an external seat on top and a backrest behind the seat. A control column and a grab handle are positioned in front of the seat. External drive motors attached to the hull drive propellers housed in protective cages. Servo driven dive planes and stern rudders provide directional control. Batteries are attached to a mounting plate positioned in channels inside the hull. The control column, drive motors, dive planes, rudders, and batteries are connected to a controller. A detachable safety key tethered to the rider is arranged to disable the drive motors and control column if the rider falls off and pulls the key from the hull. A water sensor on top of the backrest is arranged to prevent the diving planes from pitching down when the sensor detects water for limiting diving depth.

16 Claims, 3 Drawing Sheets

SUBMARINE

BACKGROUND OF THE INVENTION

1. Field of the Invention

The invention generally relates to watercraft and submarines.

2. Prior Art

A typical submarine includes a watertight passenger compartment with a life support system. Ensuring the safety and comfort of the passengers requires expensive engineering and construction. Therefore, even a small personal submarine may be much too expensive to be commercially successful.

BRIEF SUMMARY OF THE INVENTION

A submarine is comprised of an elongated hull with an external seat on top and a backrest behind the seat. A control column and a grab handle are positioned in front of the seat. External drive motors attached to the hull drive propellers housed in protective cages. Servo driven dive planes and stern rudders provide directional control. Batteries are attached to a heavy metal mounting plate positioned in channels inside the hull. The batteries and mounting plate are positioned below the axis of the hull for automatically righting the submarine. The bow section is detachable for removing the batteries and mounting plate. A tow point is attached to the bow section. The control column, drive motors, dive planes, rudders, and batteries are connected to a controller. A safety key tethered to the rider is arranged to disable the drive motors and control column if the rider falls off and pulls the key from the hull. A safety flag is attached to a pole on top of the hull. A water sensor on top of the backrest is arranged to prevent the diving planes from pitching down when the sensor detects water for limiting diving depth.

DRAWING REFERENCE NUMERALS

10. Hull
11. Seat
12. Backrest
13. Leg Rest
14. Control Column
15. Grab Handle
16. Dive Plane
17. Bow Section
18. Rudder
19. Stern Section
20. Drive Motor
21. Strut
22. Propeller
23. Cage
24. Tow Point
25. Safety Key
26. Tether
27. Safety Flag
28. Pole
29. Water Sensor

30. Battery
31. Mounting Plate
32. Channel
33. Floatation Device
34. Controller
35. Servo
36. Servo
37. Charging Port
38. Access Panel
39. Forward/Reverse Switch

DETAILED DESCRIPTION OF THE INVENTION

FIG. 1

Figure 1:
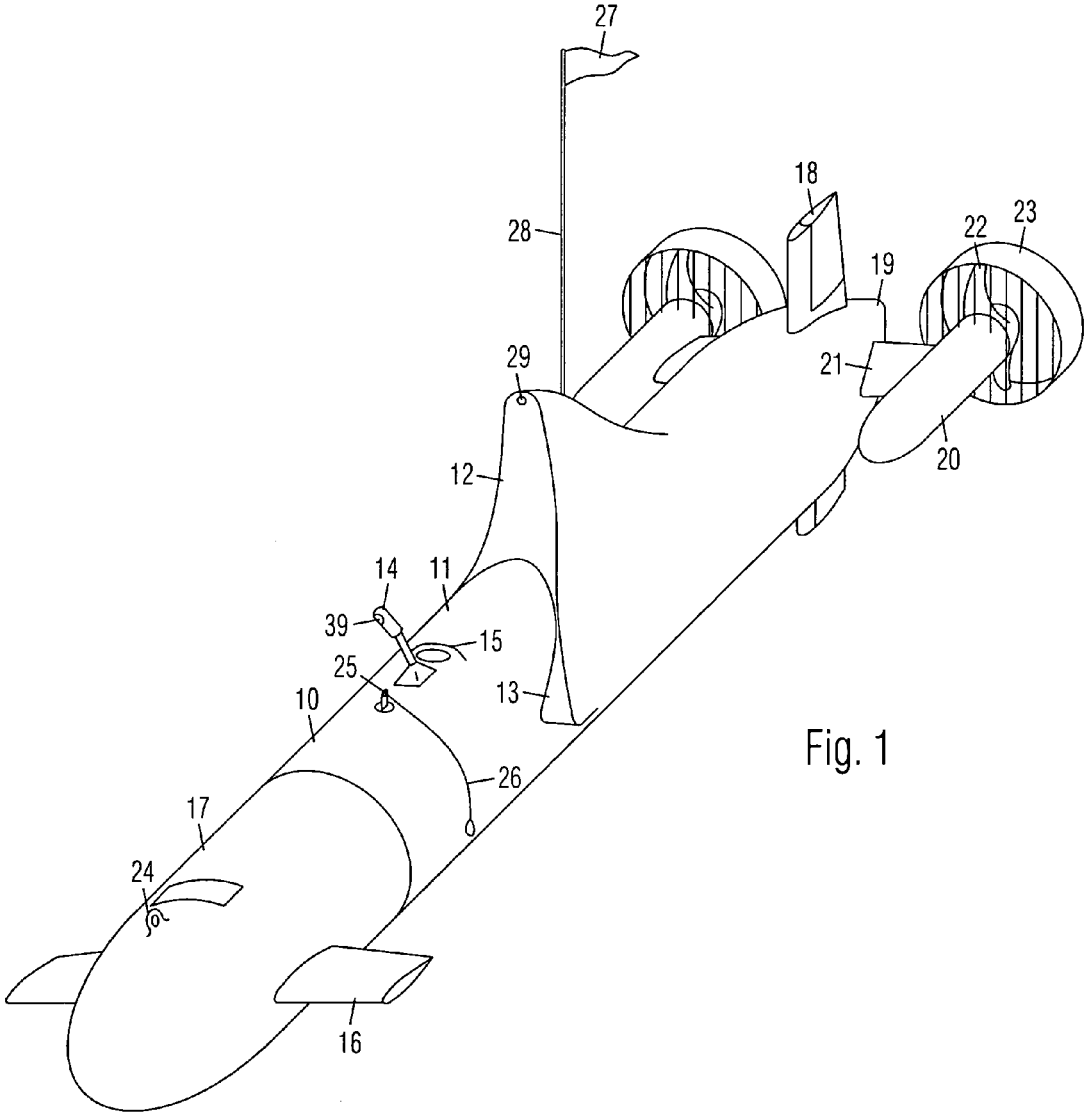
FIG. 1 is a front perspective of the submarine.

A preferred embodiment of a submarine shown in FIG. 1 is comprised of an elongated hull 10 with an external seat 11 on top for supporting a rider externally, a backrest 12 behind seat 11, and leg rests 13 on either side of hull 10 below seat 11. A control column 14 and a grab handle 15 are positioned in front of seat 11. A forward/reverse switch 39 is positioned on control column 14. Horizontal dive planes 16 on either side of a bow section 17 provide pitch control, and vertical stern rudders 18 at a stern section 19 provide yaw control. External drive motors 20 attached to side struts 21 projecting from stern section 19 drive propellers 22 in protective cages 23. A tow point 24 is attached to bow section 17 to enable towing by another vessel if necessary. A safety key 25 detachably inserted in hull 10 adjacent seat 11 is attached to a tether 26 for connecting to a rider. A safety flag 27 is attached to a pole 28 projecting up from hull 10 to help rescuers visually locate the submarine in an emergency. A water sensor 29 is arranged adjacent the top of backrest 12. Alternatively, water sensor 29 may be positioned on top of pole 28.

FIG. 2

Figure 2:
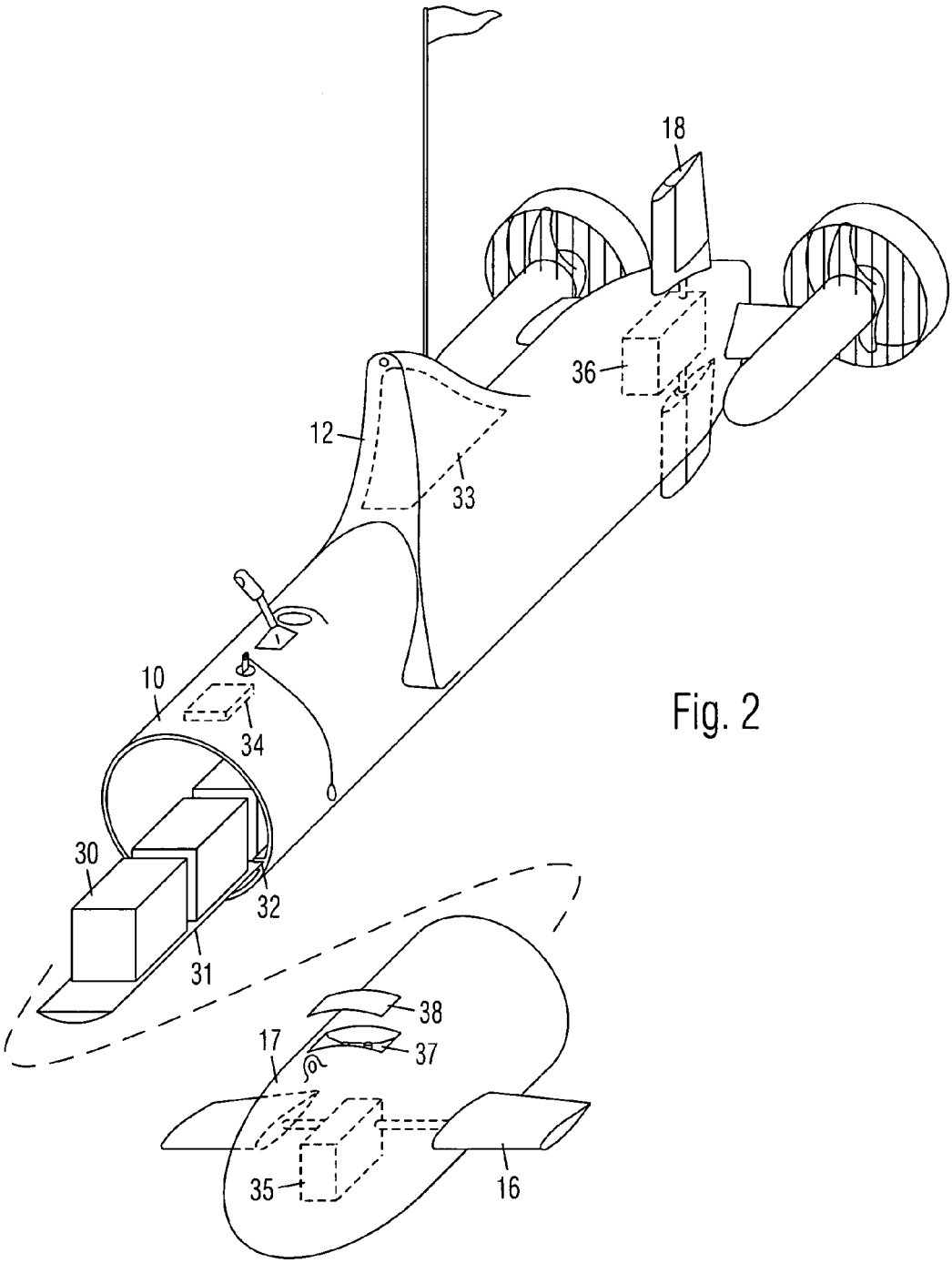
FIG. 2 is an exploded view thereof.

An exploded view of the submarine is shown in FIG. 2. Bow section 17 of hull 10 is detachable. Heavy batteries 30 are attached to a heavy metal mounting plate 31 positioned in channels 32 inside hull 10, so that plate 31 and batteries 30 may slide out of hull 10 for maintenance. Batteries 30 and mounting plate 31 are positioned with a combined center of gravity below an axis of hull 10 for automatically righting the submarine. A floatation device 33 is positioned inside backrest 12 or hull 10 for buoyancy in case of hull rupture. An electronic controller 34 is positioned inside hull 10. Servos 35 and 36 inside hull 10 are respectively connected to dive planes 16 and rudders 18. A recharging port 37 on hull 10 is covered by a removable access panel 38.

The submarine is arranged to have enough buoyancy for floating with the waterline just below the top of hull 10 when there is no rider, and to have a generally neutral buoyancy with an average size rider.

FIG. 3

Figure 3:
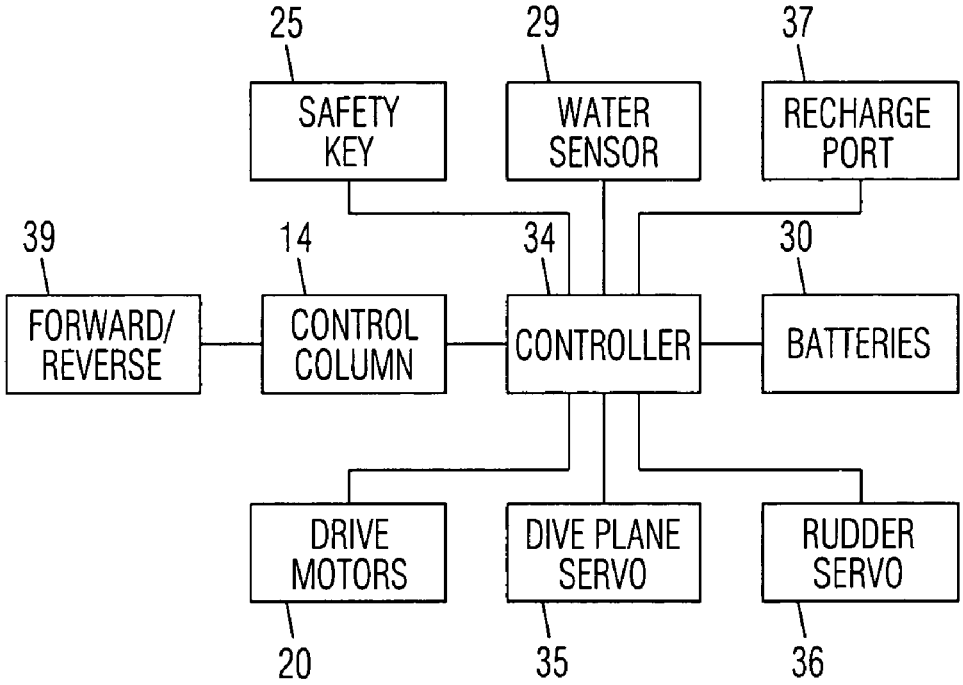
FIG. 3 is an electrical block diagram thereof.

An electrical block diagram of the submarine is shown in FIG. 3. Control column 14, drive motors 20, dive plane servo 35, rudder servo 36, batteries 30, safety key 25, water sensor 29, and recharging port 37 are connected to controller 34. Batteries 30 are recharged through controller 34 by connecting electrical power to recharging port 37.

Controller 34 is programmed to activate drive motors 20 and rotate the propellers for forward or reverse movement when forward/reverse switch 39 on control column 14 are engaged for forward or reverse movement. The rotation speed of drive motors 20 is proportional to the amount of switch depression, but reverse speed is limited to a fraction of maximum forward speed.

Controller 34 is programmed to move dive plane servo 35 to pitch the dive planes in proportion to longitudinal control column movement, and to move rudder servo 36 to deflect the rudders in proportion to lateral control column movement. Forward control column movement causes the dive planes to pitch down for descending, and rearward control column movement causes the dive planes to pitch up for ascending. Leftward control column movement causes rudder servo 36 to deflect the rudder left for yawing left, and rightward control column movement causes the rudder servo 36 to deflect the rudder right for yawing right. A combination of longitudinal and lateral control column movements causes a combination of pitch and yaw motions.

Controller 34 is programmed to enable drive motors 20 and control column 14, and disable battery charging when safety key 25 is inserted in the hull. Controller 34 is programmed to disable drive motors 20 and control column 14, and enable battery charging when safety key 25 is pulled from the hull, for example when the rider has fallen off the submarine. As an added safety measure, controller 34 is optionally programmed to prevent the dive planes from pitching down when water sensor 29 detects water to limit diving depth to the top of the headrest or wherever water sensor 29 is attached.

Although the foregoing description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

I claim:

1. A submarine, comprising:

an elongated hull;

an external seat on top of said hull for supporting a rider externally;

a backrest behind said seat;

leg rests on either side of said hull;

a control column in front of said seat;

horizontal dive planes on either side of a bow section of said hull activated by a dive plane servo;

vertical stern rudders at a stern section of said hull activated by a rudder servo;

external drive motors attached to said hull;

batteries in said hull connected to said drive motors;

propellers respectively attached to said drive motors; and a controller in said hull connected to said control column, said dive plane servo, said rudder servo, said motors, and said batteries.

2. The submarine of claim 1, further including protective cages respectively enclosing said propellers.

3. The submarine of claim 1, further including a safety key detachably connected to said hull adjacent said seat and attached to a tether for connecting to a rider, wherein when said safety key is detached from said hull, said controller is arranged to deactivate said drive motors.

4. The submarine of claim 1, further including a safety flag attached to a pole projecting up from said hull.

5. The submarine of claim 1, further including a water sensor adjacent a top of said backrest and connected to said controller, wherein when water is detected by said water sensor, said controller is arranged to deactivate said drive motors.

6. The submarine of claim 1, further including a grab handle in front of said seat.

7. The submarine of claim 1, further including a forward/reverse switch on said control column.

8. The submarine of claim 1, further including a tow point on said bow section.

9. The submarine of claim 1, wherein said batteries are attached to a metal mounting plate positioned in channels inside said hull, wherein said bow section is detachable, and said mounting plate and said batteries are removable from said hull when said bow section is detached from said hull.

10. The submarine of claim 1, wherein said batteries are positioned with a center of gravity thereof below an axis of said hull to automatically right said submarine.

11. The submarine of claim 1, further including a floatation device inside said hull for buoyancy in case of hull rupture.

12. The submarine of claim 1, further including a recharging port on said hull connected to said batteries and covered by a removable access panel.

13. The submarine of claim 1, wherein said submarine is provided with a predetermined buoyancy for floating with a top of said hull generally even with a water surface without a rider.

14. The submarine of claim 1, wherein said controller is programmed to activate said drive motors and rotate said propellers for forward movement when a forward/reverse switch on said control column is engaged for forward movement, and to activate said drive motors and rotate said propellers for reverse movement when said forward/reverse switch is engaged for reverse movement, said controller is programmed to rotate said propellers at a forward speed proportional to an amount of switch depression, and programmed to limit reverse speed to a predetermined portion of maximum forward speed.

15. The submarine of claim 1, wherein said controller is programmed to enable said drive motors and said control column, and disable battery charging when a safety key is inserted in said hull, said controller is programmed to disable said drive motors and said control column, and enable battery charging when said safety key is pulled from said hull.

16. The submarine of claim 1, wherein said controller is programmed to prevent said dive planes from pitching down when a water sensor on said hull detects water.

* * * * *